US008896494B2

(12) United States Patent
Huang et al.

(10) Patent No.: US 8,896,494 B2
(45) Date of Patent: Nov. 25, 2014

(54) HANGING TYPE MONOPOLE WIDEBAND ANTENNA

(75) Inventors: Chih-Yung Huang, Taichung County (TW); Jian-Jhih Du, Taipei (TW); Kuo-Chang Lo, Miaoli County (TW)

(73) Assignee: Arcadyan Technology Corporation, Hsinchu (TW)

( * ) Notice: Subject to any disclaimer, the term of this patent is extended or adjusted under 35 U.S.C. 154(b) by 274 days.

(21) Appl. No.: 13/616,568

(22) Filed: Sep. 14, 2012

(65) Prior Publication Data

US 2014/0002309 A1 Jan. 2, 2014

(30) Foreign Application Priority Data

Jun. 29, 2012 (TW) ..... 101123431 A

(51) Int. Cl.
*H01Q 1/50* (2006.01)
*H01Q 1/38* (2006.01)

(52) U.S. Cl.
USPC ..... 343/861; 343/700 MS

(58) Field of Classification Search
CPC ..... H01Q 1/38; H01Q 1/243; H01Q 9/0442; H01Q 9/42
USPC ..... 343/700 MS, 702, 850, 860, 846, 848
See application file for complete search history.

(56) References Cited

U.S. PATENT DOCUMENTS

| | | | | |
|---|---|---|---|---|
| 6,424,304 | B1 * | 7/2002 | Jan et al. | 343/702 |
| 7,057,560 | B2 * | 6/2006 | Erkocevic | 343/700 MS |
| 8,378,897 | B2 * | 2/2013 | Lai et al. | 343/700 MS |
| 2007/0236392 | A1 * | 10/2007 | Lee | 343/700 MS |
| 2011/0032170 | A1 * | 2/2011 | Chiang et al. | 343/860 |
| 2011/0309985 | A1 * | 12/2011 | He et al. | 343/700 MS |

FOREIGN PATENT DOCUMENTS

| | | |
|---|---|---|
| TW | 260011 | 3/2005 |
| TW | 325616 | 1/2008 |
| TW | 200824289 | 6/2008 |

* cited by examiner

*Primary Examiner* — Dameon E Levi
*Assistant Examiner* — Hasan Islam
(74) *Attorney, Agent, or Firm* — WPAT, PC; Justin King

(57) ABSTRACT

A present invention relates to a monopole wideband antenna, that is a wall mounted handing type antenna capable of providing easy frequency adjustment and operating at broad frequency band range. Moreover, the monopole wideband antenna of the invention can be applied in various electronic devices, and is advantageous in its low cost and small size since it can be fabricated directly using a means of print formation upon a circuitboard.

10 Claims, 3 Drawing Sheets

HANGING TYPE MONOPOLE WIDEBAND ANTENNA

FIELD OF THE INVENTION

The present invention relates to a monopole wideband antenna, and more particularly, to a printed monopole wideband antenna capable of mounting itself against a wall or a surface.

BACKGROUND OF THE INVENTION

In the modern era of rapidly developing technology, it is in need of an effective antenna that is small enough to be embedded in modern handheld or portable electronic device for wireless communication. For instance, there are antennas designed for cellular phones, notebook computers, or external wireless transmission devices, such as access points (APs) and card buses. Generally, there are two types of antennas, i.e. the planar inverse-F antenna (PIFA) and monopole antenna, that are already been used in the modern handheld electronic devices since they are advantageous in their simplicity in structure and good transmission performance. Taking the PIFA from the aforesaid conventional antennas for instance, for enabling signal from an electronic device to be transmitted out through a PIFA that is electronically connected to the electronic device through a coaxial cable, the electric connection between the two is generally achieved by connecting the inner conductive layer and the outer conductive layer respectively to the signal feed point and the ground point of the PIFA. Moreover, although the monopole antenna is a well-developed and ancient antenna, it is still being commonly used in modern handheld electronic devices.

There are already many studies on antenna improvement. One of which is a broadband antenna disclosed in TW Pat. No. 200924289. Nevertheless, such broadband antenna not only is structurally unstable that can fall over easily, but also is technically difficult to fabricate. Generally, an additional fixing element is required just for fixing such broadband antenna in an electronic device, and thus the production cost is increased.

There are another two antennas that are disclosed respectively in TW Pat. No. M260011 and M325616. In response to the broadband requirement of most modern electronic devices, the volumes of these two external antennas are comparatively larger so that they are not convenient in usage.

SUMMARY OF THE INVENTION

In view of the disadvantages of prior art, the primary object of the present invention is to provide a monopole wideband antenna, that is a wall mounted handing type antenna capable of providing easy frequency adjustment and operating at broad frequency band range. Moreover, the monopole wideband antenna of the invention can be applied in various electronic devices, and is advantageous in its low cost and small size since it can be fabricated directly using a means of print formation upon a circuitboard.

Another object of the invention is to provide a monopole wideband antenna whose operating frequency band range can be easily adjusted and tuned for conforming to the frequency band ranges defined in the communication protocols of Long Term Evolution (LTE), WiFi 802.11a, Ultra Wideband (UWB) and Worldwide Interoperability for Microwave Access (WiMAX).

To achieve the above objects, the present invention provides a monopole wideband antenna, adapted to be formed on a printed circuitboard, which comprises:

an antenna unit, composed of a radiation element and a frequency adjustment element that are independently disposed with respect to each other, while allowing the radiation element to be further configured with a first extension element, a second extension element and a signal feed point in a manner that the first extension element is formed extending in a first direction into a first impedance matching adjustment area; the second extension element is connected to the first extension element by one end thereof and is extending in a second direction into a primary radiation area, and the signal feed point is connect to the joint of the first and the second extension elements and is extending in a third direction, and the frequency adjustment element is arranged at a position sandwiched between the first and the second extension elements;

a ground unit, disposed neighboring to the signal feed point; and a second impedance matching adjustment area, being an area sandwiched between the ground unit and the antenna unit.

Preferably, the monopole wideband antenna further comprises:

a resistor of 50Ω, connected to the signal feed point.

Preferably, the radiation element is formed like a "Y"-shaped structure.

Preferably, the monopole wideband antenna is enabled to operate at a frequency band ranged between 4 GHz and 7 GHz.

Preferably, the frequency adjustment element is formed like a triangle island block that is disposed for enabling one of its vertex angle to be arranged neighboring to the second extension element.

Preferably, the radiation element is substantially a microstrip line.

Preferably, the radiation element is formed extending a predefined resonant length, while enabling the second extension element to extend in a length equal to one fourth of a length corresponding to a predefined resonant frequency of the monopole wideband antenna.

Preferably, the second extension element is extending in the second direction while being widened gradually.

Preferably, the first extension element is formed with at least one bend.

Preferably, the printed circuitboard is formed from a dielectric substrate.

Further scope of applicability of the present application will become more apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given herein below and the accompanying drawings which are given by way of illustration only, and thus are not limitative of the present invention and wherein.

DESCRIPTION OF THE EXEMPLARY EMBODIMENTS

For your esteemed members of reviewing committee to further understand and recognize the fulfilled functions and structural characteristics of the invention, several exemplary embodiments cooperating with detailed description are presented as the follows.

Figure 1:
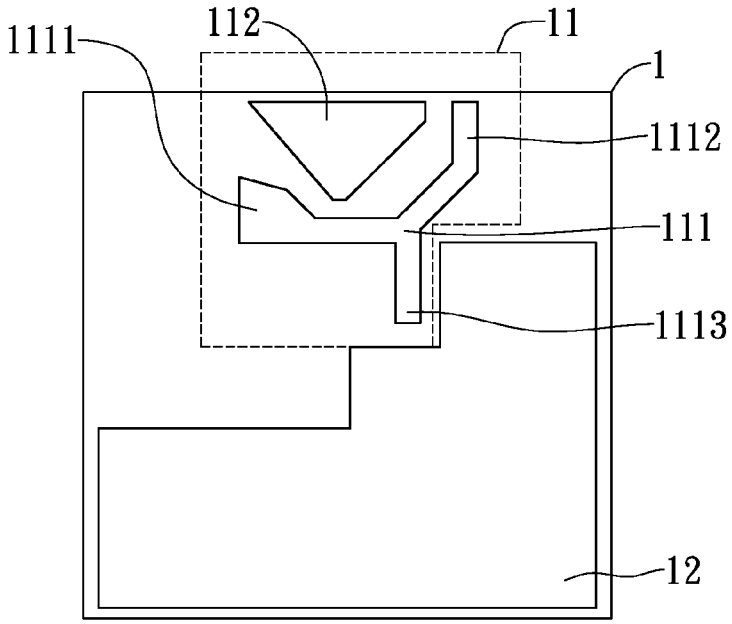
FIG. 1 is a front view of a monopole wideband antenna according to an embodiment of the present invention.
Figure 2:
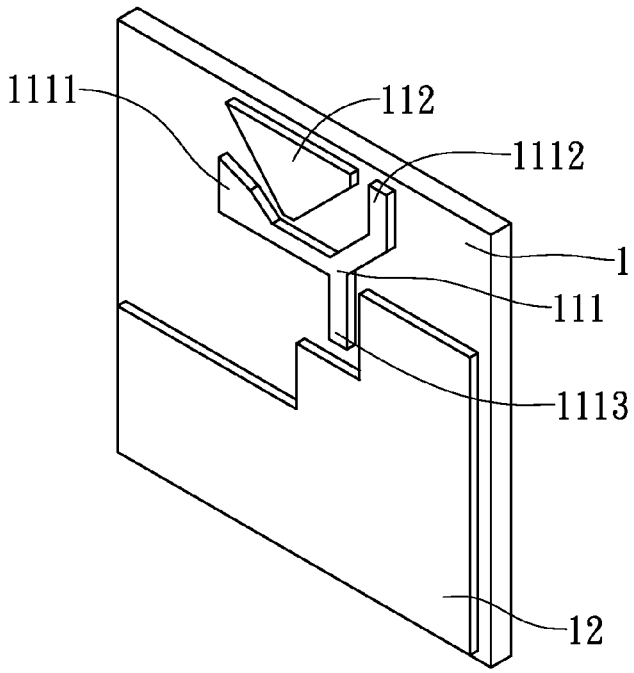
FIG. 2 is a three-dimensional view of a monopole wideband antenna according to an embodiment of the present invention.

Please refer to FIG. 1 and FIG. 2, which are a front view and a three dimensional view of a monopole wideband antenna according to an embodiment of the present invention. In this embodiment, the monopole wideband antenna is formed on a printed circuitboard 1, whereas the printed circuit board 1 is formed from a dielectric substrate. As shown in FIG. 1 and FIG. 2, the monopole wideband antenna comprises: an antenna unit 11, composed of a "Y"-shaped radiation element 111 and a frequency adjustment element 112 that are independently disposed with respect to each other, while allowing the radiation element 111 to be further configured with a first extension element 1112, a second extension element 1111 and a signal feed point 1113 in a manner that the first extension element 1112 is formed extending in a first direction into a first impedance matching adjustment area; the second extension element 1111 is connected to the first extension element 1112 by one end thereof and is extending in a second direction into a primary radiation area, and the signal feed point 1113 is connect to the joint of the first and the second extension elements 1111, 1112 and is extending in a third direction, and the frequency adjustment element is arranged at a position sandwiched between the first and the second extension elements 1111, 1112; a ground unit 12, disposed neighboring to the signal feed point 1113; and a second impedance matching adjustment area, being an area sandwiched between the ground unit 12 and the antenna unit 11. In this embodiment, the monopole wideband antenna further comprises: a resistor of 50Ω, that is arranged connecting to the signal feed point 1113; and the monopole wideband antenna is enabled to operate at a frequency band ranged between 4 GHz and 7 GHz.

Figure 3A:
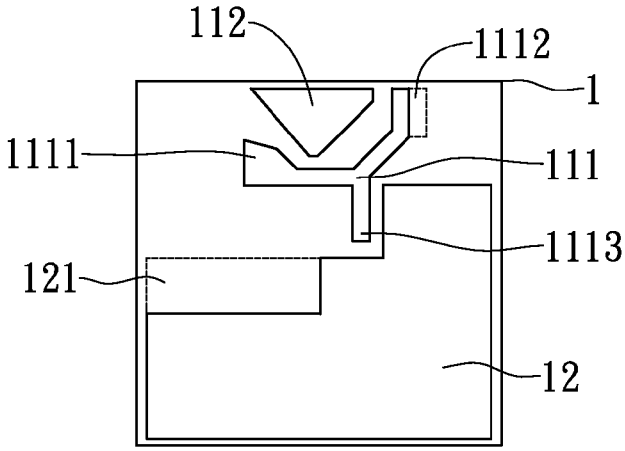
FIG. 3A to FIG. 3C are schematic diagrams respectively showing three different monopole wideband antennas that formed with different first and second impedance matching adjustment areas, and frequency adjustment element according to the present invention.
Figure 3B:
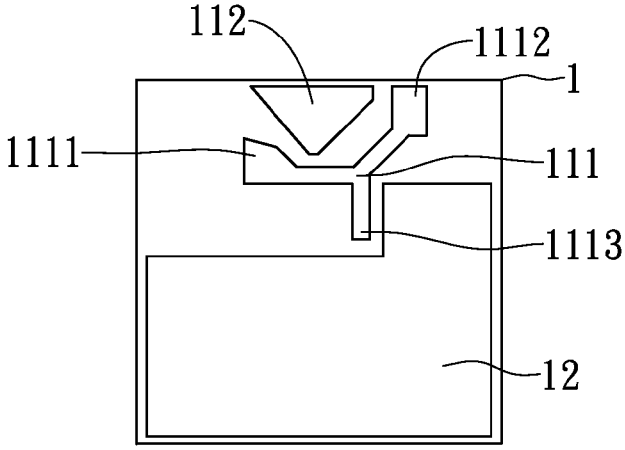
Figure 3C:
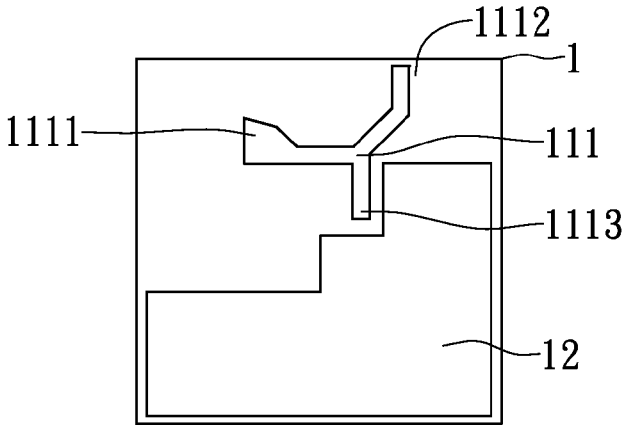

Please refer to FIG. 3A to FIG. 3C, which are schematic diagrams respectively showing three different monopole wideband antennas that formed with different first and second impedance matching adjustment areas, and frequency adjustment element according to the present invention. The intended operation frequency adjustment can be achieved either by widening the first impedance matching adjustment area 1112 of the radiation element 111, as the area enclosed within the dotted lines shown in FIG. 3A; or by filling a lower step area of the three-steps stair-like ground unit 12, as the area enclosed within the dotted line on the ground unit 12 for changing the area of the second impedance matching adjustment area 121. Thereby, the structure of the monopole wideband antennas shown in FIG. 3A is changed into the one shown in FIG. 3B, and consequently the operation frequency of the monopole wideband antenna can be adjusted accordingly.

Also for achieving operation frequency adjustment, the frequency adjustment element 112 that is formed in the monopole wideband antenna of FIG. 3A can be removed, and thus a new monopole wideband antenna as the one shown in FIG. 3C can be achieved and also the operation frequency of the monopole wideband antenna is adjusted accordingly.

In an embodiment of the present invention, the monopole wideband antenna that is formed on a printed circuitboard can substantally be formed from a microstrip line. It is noted that the microstrip line is a type of band-like electrical transmission line which can be fabricated using printed circuit board technology, and is used to convey microwave-frequency signals. It consists of a conducting strip separated from a ground plane by a dielectric layer known as the substrate. Microwave components such as antennas, can be formed from microstrip with one end being used as its signal feed point, so that the entire device existing as the pattern of metallization on the substrate. Substantially, if the conductive pattern of antenna is formed on the upper surface of a dielectric substrate, there can be a or no metallic ground plane being formed on the bottom surface of the substrate depending upon whether the entire microstrip device is a three-layer structure or a two-layer structure.

One end of the radiation element 111 of the antenna unit 11 is designated to be used as a signal feed point 1113, while allowing another end of the microstrip radiation element 111 to split and extend respectively in two different directions opposite to the ground unit 12. In this embodiment, the radiation element 111 is formed extending a predefined resonant length, while enabling the second extension element 1111 to extend in a length equal to one fourth of a length corresponding to a predefined resonant frequency of the monopole wideband antenna. It is noted that the impedance match of the monopole wideband antenna of the invention can be adjusted through the adjustment performed upon the extending portion of the radiation element 111 for enabling the voltage standing wave ratio (VSWR) to meet the required communication specification. Moreover, in this embodiment, the frequency adjustment element 112 is formed like a triangle island block that is disposed for enabling one of its vertex angle to be arranged neighboring to the second extension element 1111 so as to increase frequency bandwidth.

Figure 4:
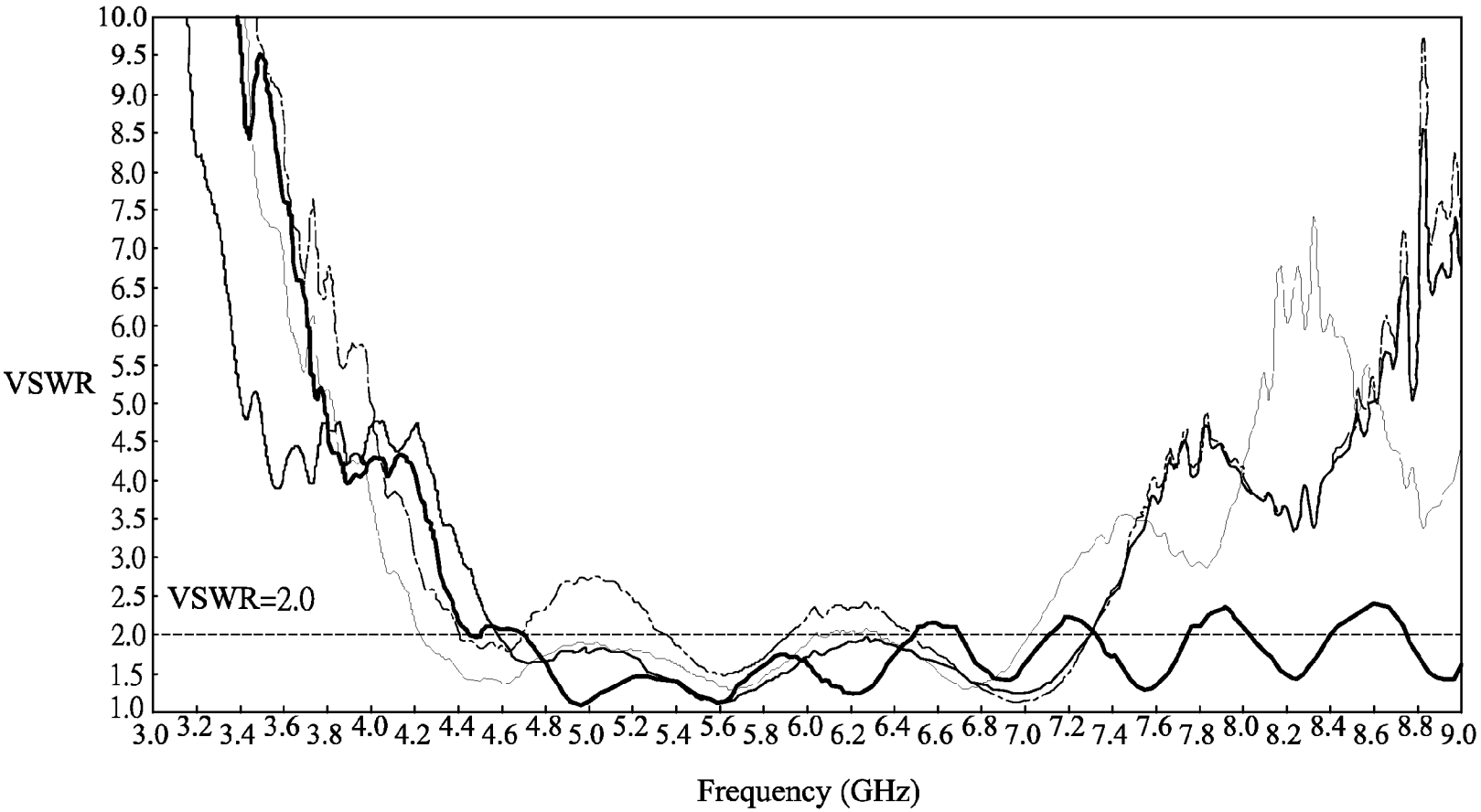
FIG. 4 is a diagram showing the relationship between VSWR and frequency according to the present invention.

Please refer to FIG. 4, which is a diagram showing the relationship between VSWR and frequency according to the present invention. As shown in FIG. 4, using the dotted line defined by VSWR=2.0 as reference, the VSWR values within a frequency range between 4.2 GHz and 7.3 GHz are all smaller than 2.0, representing that all the frequency within this range is the full effective wireless communication frequency bandwidth of the monopole wideband antenna provided in the present invention, that is able to operate conforming to the frequency band ranges defined in the communication protocols of Long Term Evolution (LTE), WiFi 802.11a, Ultra Wideband (UWB) and Worldwide Interoperability for Microwave Access (WiMAX).

To sum up, the present invention provides a monopole wideband antenna, that is a wall mounted handing type antenna capable of providing easy frequency adjustment and operating at broad frequency band range. Moreover, the monopole wideband antenna of the invention can be applied in various electronic devices, and is advantageous in its low cost and small size since it can be fabricated directly using a means of print formation upon a circuitboard.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

What is claimed is:

1. A monopole wideband antenna, adapted to be formed on a printed circuitboard, comprising:

an antenna unit, composed of a radiation element and a frequency adjustment element that are independently disposed with respect to each other, while allowing the radiation element to be further configured with a first extension element, a second extension element and a signal feed point in a manner that the first extension element is formed extending in a first direction into a first impedance matching adjustment area; the second extension element is connected to the first extension element by one end thereof and is extending in a second direction into a primary radiation area, and the signal feed point is connected to the joint of the first and the second extension elements and is extending in a third direction, and the frequency adjustment element is arranged at a position sandwiched between the first and the second extension elements;

a ground unit, disposed neighboring to the signal feed point; and a second impedance matching adjustment area, being an area sandwiched between the ground unit and the antenna unit.

2. The monopole wideband antenna of claim 1, further comprising:

a resistor of 50Ω, connected to the signal feed point.

3. The monopole wideband antenna of claim 1, wherein the radiation element is formed like a "Y"-shaped structure.

4. The monopole wideband antenna of claim 1, wherein the monopole wideband antenna is enabled to operate at a frequency band ranged between 4 GHz and 7 GHz.

5. The monopole wideband antenna of claim 1, wherein the frequency adjustment element is formed like a triangle island block that is disposed for enabling one of its vertex angle to be arranged neighboring to the second extension element.

6. The monopole wideband antenna of claim 1, wherein the radiation element is substantially a microstrip line.

7. The monopole wideband antenna of claim 1, wherein the radiation element is formed extending a predefined resonant length, while enabling the second extension element to extend in a length equal to one fourth of a length corresponding to a predefined resonant frequency of the monopole wideband antenna.

8. The monopole wideband antenna of claim 1, wherein the printed circuitboard is formed from a dielectric substrate.

9. The monopole wideband antenna of claim 1, wherein the second extension element is extending in the second direction while being widened gradually.

10. The monopole wideband antenna of claim 1, wherein the first extension element is formed with at least one bend.

* * * * *